United States Patent [19]

Winkler et al.

[11] 4,120,552

[45] Oct. 17, 1978

[54] SWITCHABLE ELECTRICAL CONNECTOR

[75] Inventors: Edward D. Winkler, Reading; Earl E. Dalrymple, Waltham, both of Mass.

[73] Assignee: Anderson Power Products, Inc., Boston, Mass.

[21] Appl. No.: 813,521

[22] Filed: Jul. 7, 1977

[51] Int. Cl.[2] ..... H01R 13/54; H01R 33/30

[52] U.S. Cl. ..... 339/90 R; 200/51.12; 200/51.13; 339/14 L; 339/75 M

[58] Field of Search ..... 339/90 R, 90 C, 75 M, 339/88 R, 64 M, 47 R, 48, 49 R, 49 B, 14 R, 14 L; 200/51 R, 51.08, 51.09, 51.12, 51.13

[56] References Cited

U.S. PATENT DOCUMENTS 3,083,274 3/1963 Sparkes ..... 200/51.09

*Primary Examiner*—Roy Lake
*Assistant Examiner*—E. F. Desmond
*Attorney, Agent, or Firm*—Richard J. Birch

[57] ABSTRACT

A switchable electrical connector for use in explosion prone environments is disclosed. The connector utilizes two pairs of electrical connectors; the first pair provides a circuit switching function while the second pair permits the removable connection of a suitable load. Sealing means are used for the first pair of electrical connectors to isolate any switching arcs from the environment. A mechanically actuated interlock is employed to prevent electrical engagement of the first pair of connectors before engagement of the second pair of connectors and to prevent disengagement of the second pair of connectors before the disengagement of the first pair of connectors.

10 Claims, 10 Drawing Figures

SWITCHABLE ELECTRICAL CONNECTOR

BACKGROUND OF THE INVENTION

The present invention relates to electrical connectors in general and, more particularly, to a switchable electrical connector.

In mines and other explosion prone environments, it is often necessary to disconnect a load from its power source in order to service the load. For example, the fluorescent lighting fixtures mounted on self-propelled mining equipment must be replaced at relatively frequent intervals. In order to avoid unnecessary downtime, it is desirable to change the fluorescent bulbs at the work site. However, the environmental conditions at the work site are such that an explosion is an ever present danger. Under these circumstances, the electrical power must be disconnected in a nonarcing manner before the load i.e. the bulb is disconnected. Conversely, the load must be connected to a dead circuit before the circuit is energized.

It is accordingly a general object of the present invention to provide an improved electrical connector having both switch and disconnect functions in a single unit.

It is a specific object of the invention to provide a switchable electrical connector having an interlock system that prevents the disconnection of the connector before the internal switch is opened and the closing of the internal switch before the connector is engaged.

It is another object of the invention to provide an explosion proof electrical connector having both switch and disconnect functions in a single connector.

It is a feature of the present invention that the open connector provides a dead front;

It is another feature of the present invention that a through ground line connection is established prior to the connection of the load and maintained for a short period after the connection of the load.

These objects and features and other objects and features of the present invention will best be understood from a detailed description of a preferred embodiement thereof, selected for purposes of illustration and shown in the accompanying drawings, in which.

DETAILED DESCRIPTION OF A PREFERRED EMBODIMENT

Figure 1A:
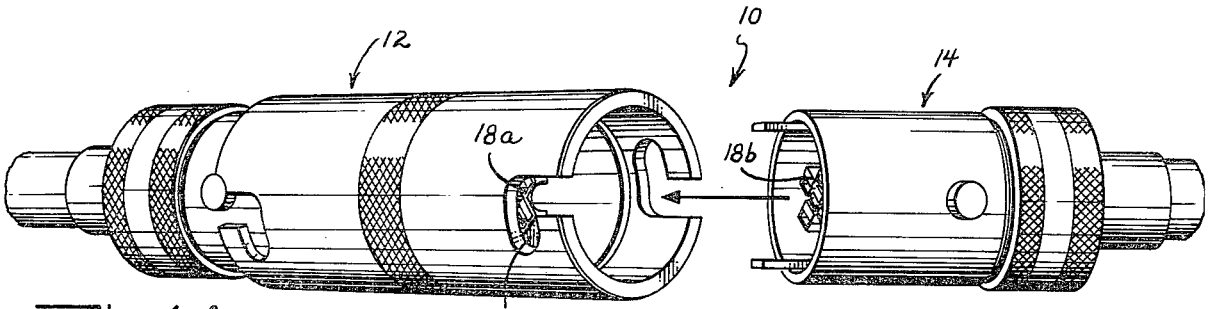
FIG. 1A is a view in perspective of the switchable electrical connector of the present invention showing the receptacle assembly and plug assembly portions thereof positioned to be mated together.
Figure 1B:
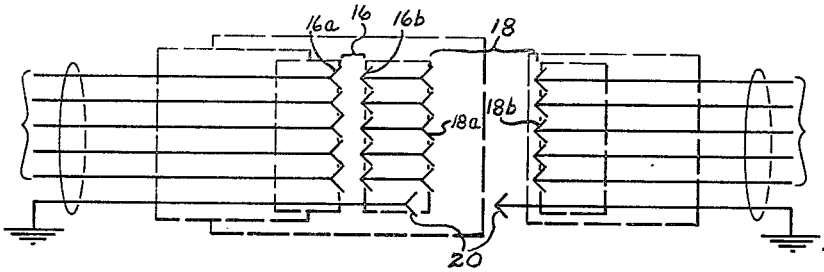
FIG. 1B is an illustrative schematic representation of the electrical connectors contained within the receptacle and plug assemblies shown in FIG. 1A.
Figure 2A:
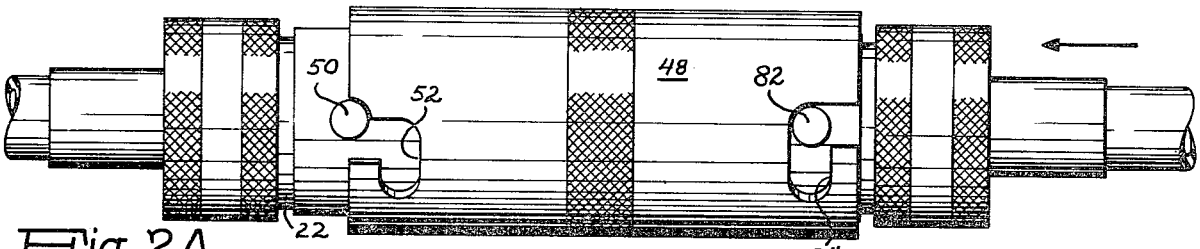
FIG. 2A is a view in side elevation showing the plug assembly inserted into the receptacle assembly.
Figure 2B:
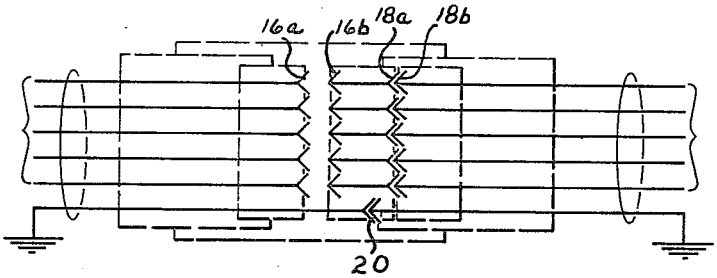
FIG. 2B is another illustrative schematic representation of the position of the electrical connectors when the plug assembly is in the position shown in FIG. 2A.
Figure 3A:
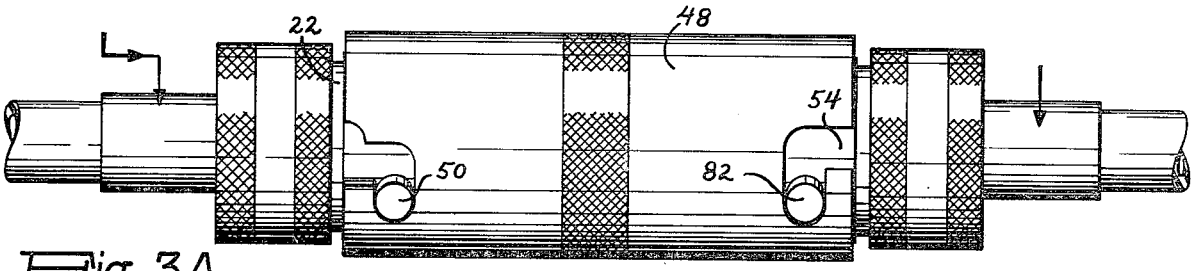
FIG. 3A illustrates the final position of the plug and receptacle assemblies when the switch portion of the connector is in the closed position.
Figure 3B:
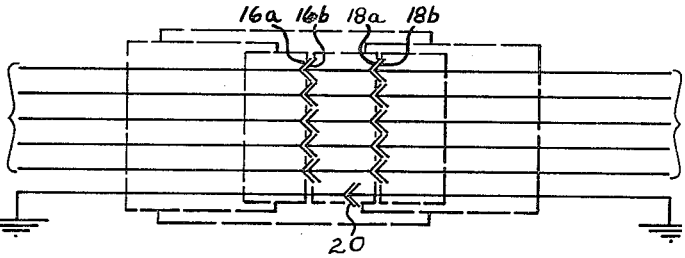

Turning now to the drawings, there is shown a switchable electrical connector constructed in accordance with the present invention and indicated generally by the reference numeral 10. The connector 10 has two major assemblies: a receptacle assembly 12 and a mating plug assembly 14. Electrically, the connector 10 comprises two pairs of electrical connectors 16 and 18, each having respectively at least one set of electrical connectors **16*a*-16*b* and 18*a*-18*b*. If desired, more than one set of connectors can be employed as shown in FIGS. 1B, 2B and 3B to form banks of electrical connectors. A through ground line electrical connector 20 is provided to maintain ground continuity. The plug assembly connectors 18*b* are connected to a load(s) while the receptacle assembly connectors 16*a* are connected to the line or other power source. The sequential electrical operation of the switchable electrical connector 10 is shown illustratively in FIGS. 1B, 2B and 3B. The corresponding physical representations are depicted in the sequential views of FIGS. 1A, 2A and 3A. Looking at FIGS. 1A–1B and 2A–2B, when the plug assembly 14 is inserted in the receptacle assembly 12, the electrical connectors 18A and 18B are moved into electrical engagement as shown in FIG. 2A. The electrical connectors 18*a* are electrically connected to connectors 16*b*. Connectors 16B and 18*a*** can be a single, double ended connector or separate connectors electrically connected together by means of a wire.

Given the position shown in FIG. 2A and illustrated electrically in the schematic representation in FIG. 2B, it can be seen that the load is now connected through electrical contacts **18*a* and 18*b* to the switching contact 16*b*. Note however, that contact 16*b* is not yet engaged with its corresponding contact 16*a* which is connected to the power source. When the plug and receptacle assembly are pushed together and rotated as shown in FIG. 3A, the resulting electrical configuration is that depicted in FIG. 3B. At this point, the electrical connectors 16*a*-16*b* and 18*a*-18*b*** are in complete electrical engagement to provide a through connection from the power source to the load.

It will be appreciated that the pair of electrical connectors **16*a* and 16*b* perform a switching function while the pair of electrical connectors 18*a* and 18*b* perform the connect-disconnect function for the load. In order to prevent the engagement of the switching contacts 16*a* and 16*b* before engagement of the load contacts 18*a* and 18*b* and, conversely, the disengagement of the load contacts 18*a* and 18*b* before the switching contacts 16*a* and 16*b* are disengaged, the electrical connector is provided with a mechanical interlock system. This system will be described below after a detailed descrition of the mechanical and electrical components of the switchable electrical connector 10**.

Having briefly described the electrical operation of the switchable electrical connector of the present invention, reference will now be made to the detailed structure of the connector as best seen in FIGS. 1A, 2A, 3A and 4 through 7. The receptacle assembly 12 has a generally cylindrical, threaded sleeve on housing 22 to which is threadably secured an apertured end cap 24. The end cap 24 is firmly locked to sleeve 22 by means of a set screw 26. A cable hose 28 extends through the aperture of end cap 24 and surrounds an electrical cable 30 having a plurality of circuit wires 32 and a separate ground wire 34.

A connector block 36 containing one or more of the previously mentioned electrical connectors 16*a* is positioned within sleeve 22 and held therein under spring pressure by means of spring 38 and screw 40. A second connector block 41 is also secured to the sleeve by screw 40. The second connector block contains one or more of the previously mentioned electrical connectors 16*b* and 18*a*.

The cable circuit wires 32 are electrically connected to the corresponding electrical connector(s) 16*a* by conventional means, such as, crimping or soldering. The ground wire 34 is connected through a crimp connector 42 to an electrically conductive ground spring 44 by means of terminal screw 45. The round spring 44 is secured to connector block 36 by a rivet 46. A housing ground spring 47 is electrically and physically connected to the ground spring 44 by rivet 46. This spring provides a grounding contact between the ground wire 34 and sleeve 22 as shown in FIG. 5.

A wide variety of existing electrical connectors can be used for the connectors 16*a*-16*b* and 18*a*-18*b*. For example, standard pin and socket connectors or hermaphroditic connectors, such as, those sold by Anderson Power Products, Inc. under the registered trademark POWERPOLE can be employed. The latter connectors are described in U.S. Pat. Nos. 3,218,599 and 3,259,870.

Figures 4, 5, 6, 7:
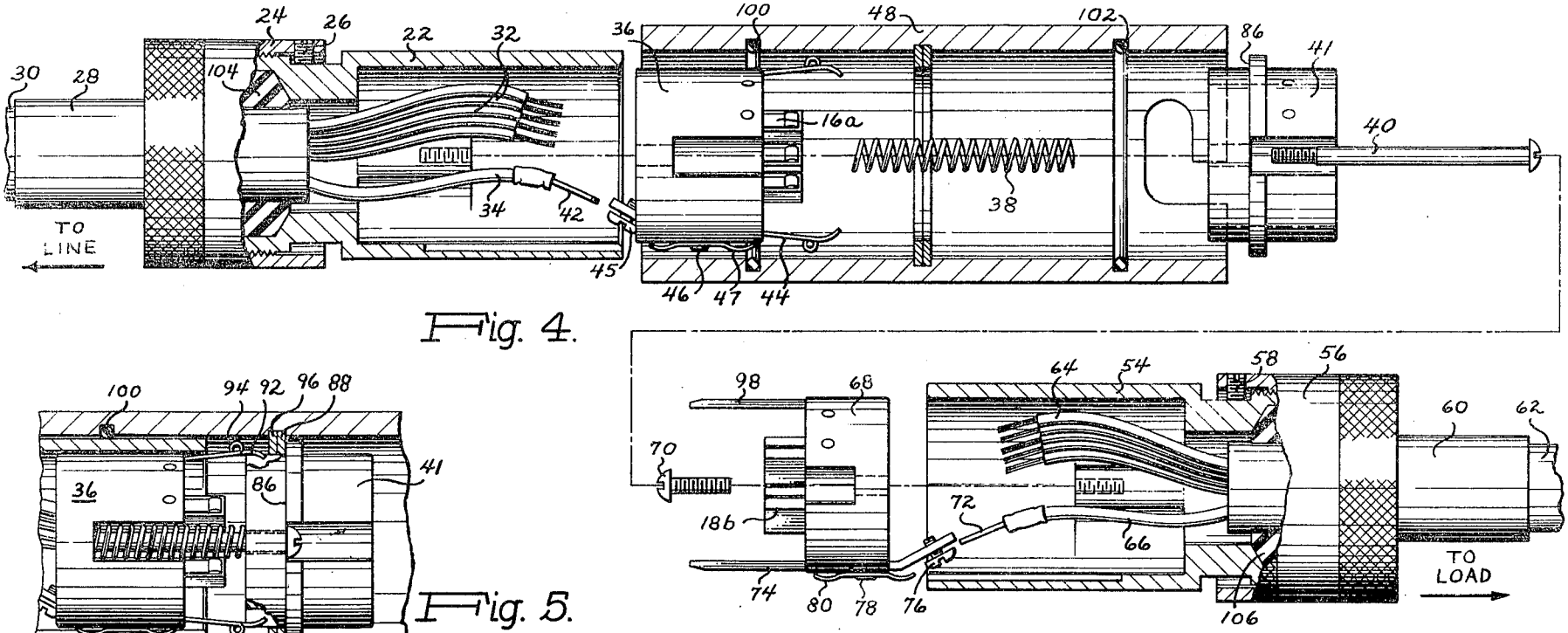
FIG. 4 is an exploded view in side elevation and partially broken away of the receptacle and plug assemblies.
FIGS. 5, 6 and 7 are views in side elevation and partial section of a portion of the receptacle and plug assemblies showing the sequential engagement of the two pairs of electrical connectors.

The right-hand portion of sleeve 22, as shown in FIG. 4, is positioned within a larger, generally cylindrical intermediate housing 48. The sleeve 22 and the components mounted therein are free to move axially within the intermediate housing 48 and to rotate about the axis thereof subject only to the constraints imposed by a bayonet 50 mounted on the exterior surface of sleeve 22, as best seen in FIGS. 1A, 2A and 3A, and by a corresponding, interlocking axially and circumferentially extending slot 52 formed in the intermediate housing 48. The operative relationship of the sleeve bayonet 50 and intermediate housing slot 52 will be discussed below in greater detail in connection with the electrical interlocking feature between electrical connector pairs 16 and 18.

Turning now to the plug assembly 14, the plug assembly has many components that correspond to the components of the receptacle assembly 12 discussed above. The plug assembly has a sleeve 54, an apertured end cap 56, a set screw 58, a cable hose 60 and an electrical cable 62 having a plurality of wires 64 and a separate ground wire 66. The plug assembly electrical connectors 18*b* are mounted in a connector block 68 which in turn is mounted within the sleeve 54 by means of fastening screw 70. The plug assembly wires 64 are electrically secured to electrical connectors 18*b* by conventional means. The ground wire 66 is secured through crimp terminal 72 to an electrically conductive ground blade 74 by means of a terminal screw 76. The ground blade 74 is secured to the connector block 68 by means of rivet 78 which also secures a sleeve ground spring 80 to the ground blade 74. The ground spring 80 provides a grounding path between the ground blade and the sleeve or housing 54 as shown in FIG. 6.

When the plug assembly 14 is inserted within the intermediate housing 48, as shown in FIGS. 2A and 3A, it is free to move axially within the housing 48 and to rotate therein subject only to the constraints imposed by a bayonet 82 mounted on the outer surface of sleeve 54 and by the cooperative axially and circumferentially extending slot 84 formed in the intermediate housing 48. The function of the plug and receptacle bayonets 82 and 50, respectively, will be discussed below.

Referring now to FIGS. 5 through 7, FIG. 5 depicts the relationship of the connector blocks 36 and 41 when the receptacle assembly is in the position shown in FIG. 1A. The connector block 41 has a shoulder 86 that seats against a ring 88 located within the intermediate housing 48. Given this arrangement it will be appreciated that sleeve 22 cannot be withdrawn from the intermediate housing 48 without first unscrewing screw 40.

The connector block 36 is held away from connector block 41 by means of the spring-loading provided by spring 38. Since connector block 36 contains the electrical connectors 16*a* while the connector block 41 contains the corresponding connector 16*b*, the spaced positions of these two connector blocks represents the switch "Open" condition of the electrical connector 10.

Axial movement of the connector block 36 beyond a certain point to the right, as viewed in FIG. 5, is limited by means of a latch portion 90 on grounding spring 44 and by a corresponding latch spring 92 having a latch portion 94 in their normal positions, as illustrated in FIG. 5, the latch portions 90 and 94 extend outwardly beyond the aperture provided by a latch ring 96 positioned within the intermediate housing 48.

Given this physical relationship, it will be appreciated that the latch portions 90 and 94 will prevent the rightward movement, as viewed in FIG. 5, of the connector block 36 beyond the position at which the latch portions contact the latch ring 96. Since connector block 41 cannot move to the left beyond ring 88 and since connector block 36 cannot move to the right beyond the abutting position between latch portions 90 and 94 and latch ring 96, the connectors 16*a* in connector block 36 and their corresponding connectors 16*b*, in connector block 41 cannot be electrically engaged unless the ground spring 44 and latch spring 92 are compressed inwardly to permit their corresponding latch portions 90 and 94 to clear the latch ring 96. The inward compression of springs 44 and 92 is provided by the previously mentioned ground blade 74 and a latch blade 98 mounted on the plug assembly connector block 68.

When the plug assembly is inserted into the intermediate housing as shown in FIG. 2A, the connectors 18*b* in plug connector block 68 electrically engage the connectors 18a in connector block 41 as illustrated physically in FIG. 6 and electrically in FIG. 2B. At the same time, the ground and latch blades 74 and 98, respectively, inwardly compress the springs 44 and 90 so that the latch portions 90 and 94 are free to clear the latch ring 96.

Although the load connecting and disconnecting electrical connectors 18*a* and 18*b* are engaged, the switching connectors 16*a* and 16*b* are still disengaged i.e., the switch is "Open". In order to close the switch by engaging connectors 16*a* and 16*b*, the receptacle assembly sleeve 22 and plug assembly sleeve 54 are rotated until bayonet 50 is aligned with the axial portion of slot 52. At this point, the plug assembly bayonet 82 is locked within slot 84 and the receptacle assembly sleeve can be pushed into the intermediate housing 48 to electrically engage connectors 16*a* and 16*b* as shown physically in FIG. 7 and electrically in FIG. 3B.

In order to disconnect the load, both the receptacle and plug assembly sleeves 22 and 54 are rotated in the opposite direction. When bayonet 50 reaches the axially extending portion of slot 52, the previously compressed spring 38, as shown in FIG. 7, forces apart connector blades 36 and 41 thereby disengaging the switch connectors 16*a* and 16*b*. Note that at this point, plug assembly bayonet 82 is still held within slot 84 so that the plug assembly cannot be removed until the switch connectors are in the disengaged or switch "Open" position. Further rotation of the two assemblies will permit bayonet 82 to clear the circumferentially extending portion of slot 84 so that the plug assembly can be removed from the receptacle assembly.

From the preceding description, it will be appreciated that the switch connectors 16*a* and 16*b* cannot be engaged unless the load connectors 18*a* and 18*b* are first engaged and, conversely, the load connectors 18*a* and 18*b* cannot be disengaged until the switch connectors 16*a* and 16*b* are disengaged. This interlocking arrangement of electrical connectors insures that the plug assembly will always be connected to and disconnected from an electrically dead open front on the receptacle assembly.

Any arcing that may occur happens only upon the engagement or disengagement of the switch connectors 16*a* and 16*b*. Both these connectors as well as the load connectors 18*a* and 18*b* are sealed from the outside environment by means of O-rings 100 and 102 and by end cap packings 104 and 106. The long metal-to-metal contact between the intermediate housing 48 and sleeves 22 and 54 cools any hot gases produced by arcing thereby preventing the escape of gases at temperature sufficient to cause an explosion.

Having described in detail a preferred embodiment of our invention, it will now be apparent to those skilled in the art that numerous modifications can be made therein without departing front the scope of the invention. For instance, although the sleeves and intermediate housings have been described as having a generally cylindrical shape, other configurations can be employed to achieve the functions of the switchable electrical connector of the present invention.

What we claim and desire to secure by Letters Patent of the United States is:

1. A switchable electrical connector comprising:

a first generally cylindrical housing;

first and second movable electrical connectors mounted in said first generally cylindrical housing for relative axial movement and relative unitary rotational movement therein, said first and second connectors being adapted for electrical engagement and disengagement with each other;

a third movable electrical connector mounted in said first housing for axial and rotational movement therein, said third electrical connector being electrically connected to said second electrical connector;

a second generally cylindrical housing having an outside diameter less than the inside diameter of said first generally cylindrical housing;

a fourth electrical connector mounted in said second generally cylindrical housing and adapted for electrical engagement and disengagement with the third electrical connector mounted in said first generally cylindrical housing; and, cooperatively operative interlock means mounted on said first and second housings for preventing: (i) the electrical engagement of said first and second electrical connectors before the electrical engagement of said third and fourth electrical connectors; and (ii) the electrical disengagement of said third and fourth electrical connectors before the electrical disengagement of said first and second electrical connectors.

2. A switchable electrical connector comprising:

a first generally cylindrical housing;

a first electrical connector mounted in said first generally cylindrical housing;

a second electrical connector adapted for electrical engagement and disengagement with said first electrical connector;

a third electrical connector electrically connected to said second electrical connector;

means for mounting said second and third electrical connectors for axial relative movement with respect to said first electrical connector to permit electrical engagement and disengagement of said second electrical connector therewith, said mounting means providing for unitary rotational movement of the second and third electrical connectors with the first electrical connector and relative to the first generally cylindrical housing;

an intermediate generally cylindrical housing having an inside diameter larger than the outside diameter of the first generally cylindrical housing, said first generally cylindrical housing being positioned at least in part within said intermediate generally cylindrical housing for axial and rotational movement therein;

a second generally cylindrical housing having an outside diameter less than the inside diameter of said intermediate generally cylindrical housing;

a fourth electrical connector mounted in said second generally cylindrical housing and adapted for electrical engagement and disengagement with said third electrical connector; and, cooperatively operative interlock means on said first and second housings for preventing (i) the electrical engagement of said first and second electrical connectors before the electrical engagement of said third and fourth electrical connectors; and (ii) the electrical disengagement of said third and fourth electrical connectors before the electrical disengagement of said first and second electrical connectors.

3. The electrical connector of claim 2 further comprising means for sealing said first and second electrical connectors in both the electrically engaged and disengaged positions from the environment.

4. The electrical connector of claim 2 wherein said interlock means comprises spring-loaded means mounted on said first electrical connector for engaging a stop means on said intermediate housing to limit axial movement of the first electrical connector in one direction and means mounted on said second housing for disengaging said spring-loaded means when said third and fourth electrical connectors are electrically engaged whereby said first electrical connector is free to move in said one axial direction to electrically engage said second electrical connector.

5. The electrical connector of claim 4 further comprising releasable spring-loaded means for electrically disengaging said first and second electrical connectors.

6. The electrical connector of claim 2 wherein said interlock means comprises a radially extending bayonet on each of said first and second housings, corresponding axially and circumferentially extending bayonet receiving slots formed in said intermediate housing, said slots and bayonets being positioned with respect to each other so that when the first housing bayonet is positioned within the axial portion of its corresponding intermediate housing slot, the second housing bayonet is located within the circumferentially extending portion of the corresponding intermediate housing slot, and spring means for disengaging said first and second electrical connectors when the first housing bayonet is moved from the circumferential portion to the axial portion of its intermediate housing slot.

7. The electrical connector of claim 6, wherein said first, second and intermediate housings are electrically conductive and, wherein said radially extending bayonets are electrically conductive and in electrical contact with their respective housings so that the interlock means provides a ground safety electrical path that is completed before the electrical engagement of said first and second electrical conductors and is broken after the electrical disengagement of said third and fourth electrical connectors.

8. A switchable electrical connector comprising:

a first generally cylindrical housing;

a first bank of electrical connectors mounted in said first generally cylindrical housing;

a second bank of electrical connectors adapted for electrical engagement and disengagement with said first bank electrical connectors;

a third bank of electrical connectors electrically connected to said second bank electrical connectors;

means for mounting said second and third banks of electrical connectors for axial relative movement with respect to said first bank electrical connectors to permit electrical engagement and disengagement of said second bank electrical connectors therewith, said mounting means providing for unitary rotational movement of the second and third bank electrical connectors with the first bank electrical connectors and relative to first generally cylindrical housing;

an intermediate generally cylindrical housing having an inside diameter larger than the outside diameter of the first generally cylindrical housing, said first generally cylindrical housing being positioned at least in part within said intermediate generally cylindrical housing for axial and rotational movement therein;

a second generally cylindrical housing having an outside diameter less than the inside diameter of said intermediate generally cylindrical housing;

a fourth bank of electrical connectors mounted in said second generally cylindrical housing and adapted for electrical engagement and disengagement with said third bank electrical connectors; and, cooperatively operative interlock means on said first and second housings for preventing (i) the electrical engagement of said first and second bank electrical connectors before the electrical engagement of said third and fourth bank electrical connectors; and (ii) the electrical disengagement of said third and fourth bank electrical connectors before the electrical disengagement of said first and second bank electrical connectors.

9. The electrical connector of claim 8 further including a through ground line electrical connector in said third bank of electrical connectors and a corresponding through ground line electrical connector in said fourth bank of electrical connectors.

10. The electrical connector of claim 8 wherein said third and fourth bank through ground line connectors make-first and break-last with respect to the electrical engagement and disengagement of said third and fourth banks of electrical connectors.

* * * * *